US005967039A

United States Patent [19]

Kennedy

[11] Patent Number: 5,967,039

[45] Date of Patent: Oct. 19, 1999

[54] CREDIT CARD IMPRINTER

[75] Inventor: Randall John Kennedy, Kitchener, Canada

[73] Assignee: NBS Technologies, Inc., Ontario, Canada

[21] Appl. No.: 09/250,172

[22] Filed: Feb. 16, 1999

[51] Int. Cl.[6] ..... B41F 3/20

[52] U.S. Cl. ..... 101/269

[58] Field of Search ..... 101/269

[56] References Cited

U.S. PATENT DOCUMENTS 5,385,094 1/1995 Kennedy ..... 101/269

*Primary Examiner*—Edgar Burr
*Assistant Examiner*—Darius N. Cone
*Attorney, Agent, or Firm*—Antonelli, Terry, Stout & Kraus, LLP

[57] ABSTRACT

An imprinter of simplified construction, including a base having a flatbed for receiving at least one character bearing element having characters to be imprinted on a print receiving element, and having a pair of opposed upwardly extending sides as well as a lid having a top surface, a pair of platen holder supports, and downwardly extending sides engaged with and slidable along the upwardly extending sides of the base to support the lid for sliding motion in first and second opposed directions along the flatbed and to limit movement of the lid orthogonal to the flatbed during movement in the first and second directions. In the imprinter of the present invention, each of the platen holder supports has a pair of opposed sidewalls having opposed axle supporting openings therein, wherein the axle supporting openings have at least two lobe shaped portions, each having a closed end and an open end, joined together at their open ends to form a substantially L-shaped opening, wherein closed ends of the respective, opposed first lobes substantially face the first direction and the closed ends of the respective, opposed second lobes substantially face the flatbed. First and second rolling platens are attached to the platen holder supports of the lid, each of the first and second rolling platens having an axle supported in the opposed axle supporting openings of the sidewalls. In this manner, the forces applied during movement of the lid in the first direction cause the axles of the rolling platens to move into the first lobes so that peripheries of the rolling platens are forced towards the flatbed to imprint characters from the at least one character bearing element on the print receiving element, and forces applied during movement of the lid in the second direction cause the axles of the rolling platens to move into the second lobes so that a periphery of the rolling platen is allowed to move away from the flatbed.

2 Claims, 4 Drawing Sheets

CREDIT CARD IMPRINTER

TECHNICAL FIELD

The present invention relates to imprinters used for imprinting characters from character bearing elements, such as merchant plates and credit cards, onto print receiving elements, such as formsets, used in credit transactions, and, in particular, to a so-called mini or portable imprinter.

The assignee of the present invention manufactures imprinters which are used for making imprints of a merchant's station plate and a credit card onto a formset for recording a credit transaction. So-called mini or portable imprinters can be used for merchant's without a permanent retail location or by merchants who are away from their primary retail location.

The assignee manufactures a mini or portable imprinter which is made primarily of thermoplastically molded parts, including a base having a flatbed for receiving the merchant's station plate, a credit card, and the formset, the base having a pair of opposed upwardly extending sides. A lid having a top surface, a pair of platen holder supports, and downwardly extending sides is provided so that the lid is engaged with and movable along the upwardly extending sides of the base. The upwardly extending sides of the base have inwardly extending lips. While the underside of the top surface of the lid can slide on the top surfaces of these lips, the bottom surfaces of the lips are engaged by a wheel assembly connected to the underside of the lid. Thus, the lips are engaged between the wheel assemblies and the underside of the top surface of the lip. The platen holder supports are connected to the underside of the top surface of the lid and support a pair of rolling platens, one of which imprints information from the credit card and the other of which imprints information from the merchant's station plate onto the formset. The information from both the credit card and station plate is imprinted onto the formset by moving the lid in a first direction with respect to the flat bed. The supports are provided to rotate about an axis parallel to the axis of the rolling platens so that the rolling platens can be partially lifted so as to not exert force on the formset, credit card and station plate during the return stroke of the lid. Since the information from both the credit card and station plate are imprinted with the first stroke in one direction and not with the second stroke in the other direction, this type of imprinter is called a double platen, single stroke imprinter. The platen holders are biased in the position to exert force on the formset, credit card and station plate during the first stroke by a spring bias.

While the above-described mini or portable imprinter achieves acceptable imprinting on the formset, the mounting of the platen holder supports in a rotatable manner, including the inclusion of the spring bias, as well as the mountings necessary to provide the wheels which engage the underside of the lips of the side wall of the base, complicate construction of the imprinter, thereby increasing the cost of manufacture.

Therefore, it is desired to provide an imprinter, especially a mini or portable imprinter, of a more simplified construction, thereby reducing the manufacturing cost.

SUMMARY OF THE INVENTION

The present invention provides an imprinter of simplified construction, the imprinter including a base having a flatbed for receiving at least one character bearing element having characters to be imprinted on a print receiving element, and having a pair of opposed upwardly extending sides as well as a lid having a top surface, a pair of platen holder supports, and downwardly extending sides engaged with and slidable along the upwardly extending sides of the base to support the lid for sliding motion in first and second opposed directions along the flatbed and to limit movement of the lid orthogonal to the flatbed during movement in the first and second directions. In the imprinter of the present invention, each of the platen holder supports has a pair of opposed sidewalls having opposed axle supporting openings therein, wherein the axle supporting openings have at least two lobe shaped portions, each having a closed end and an open end, joined together at their open ends to form a substantially L-shaped opening, wherein closed ends of the respective, opposed first lobes substantially face the first direction and the closed ends of the respective, opposed second lobes substantially face the flatbed. First and second rolling platens are attached to the platen holder supports of the lid, each of the first and second rolling platens having an axle supported in the opposed axle supporting openings of the sidewalls. In this manner, the forces applied during movement of the lid in the first direction cause the axles of the rolling platens to move into the first lobes so that peripheries of the rolling platens are forced towards the flatbed to imprint characters from the at least one character bearing element on the print receiving element, and forces applied during movement of the lid in the second direction cause the axles of the rolling platens to move into the second lobes so that a periphery of the rolling platen is allowed to move away from the flatbed.

In another embodiment of the invention, a so-called double platen, double stroke imprinter is provided, i.e., an imprinter which prints the characters from the station plate on one stroke and the characters from the credit card on the opposite stroke. The double stroke embodiment differs from the above-described single stroke embodiment in that the first rolling platen unit has opposed axle supporting openings having closed ends of the respective, opposed first lobes substantially facing the first direction and the closed ends of the respective, opposed second lobes substantially facing the flatbed, while the second rolling platen unit has opposed axle supporting openings having closed ends of the respective, opposed first lobes substantially facing the second direction and the closed ends of the respective, opposed second lobes substantially facing the flatbed. The first and second rolling platens are attached to the platen holder supports of the lid, each of the first and second rolling platens having an axle supported in the opposed axle supporting openings of the sidewalls. In this manner, forces applied during movement of the lid in the first direction cause the axle of the rolling platen of the first rolling platen unit to move into the first lobes so that a periphery of the rolling platen is forced towards the flatbed to imprint characters from the at least one character bearing element on the print receiving element, and cause the axle of the rolling platen of the second rolling platen unit to move into the second lobes so that a periphery of the rolling platen is allowed to move away from the flatbed so that smudging of the formset is reduced. Conversely, forces applied during movement of the lid in the second direction cause the axle of the rolling platen of the second rolling platen unit to move into the first lobes so that a periphery of the second rolling platen is forced towards the flatbed to imprint characters from the at least one character bearing element on the print receiving element, and cause the axle of the rolling platen of the first rolling platen unit to move into the second lobes so that a periphery of the second rolling platen is allowed to move away from the flatbed.

DETAILED DESCRIPTION OF THE PREFERRED EMBODIMENTS

A preferred embodiment of the imprinter of the present invention is shown in FIGS. 1–7.

Figure 1:
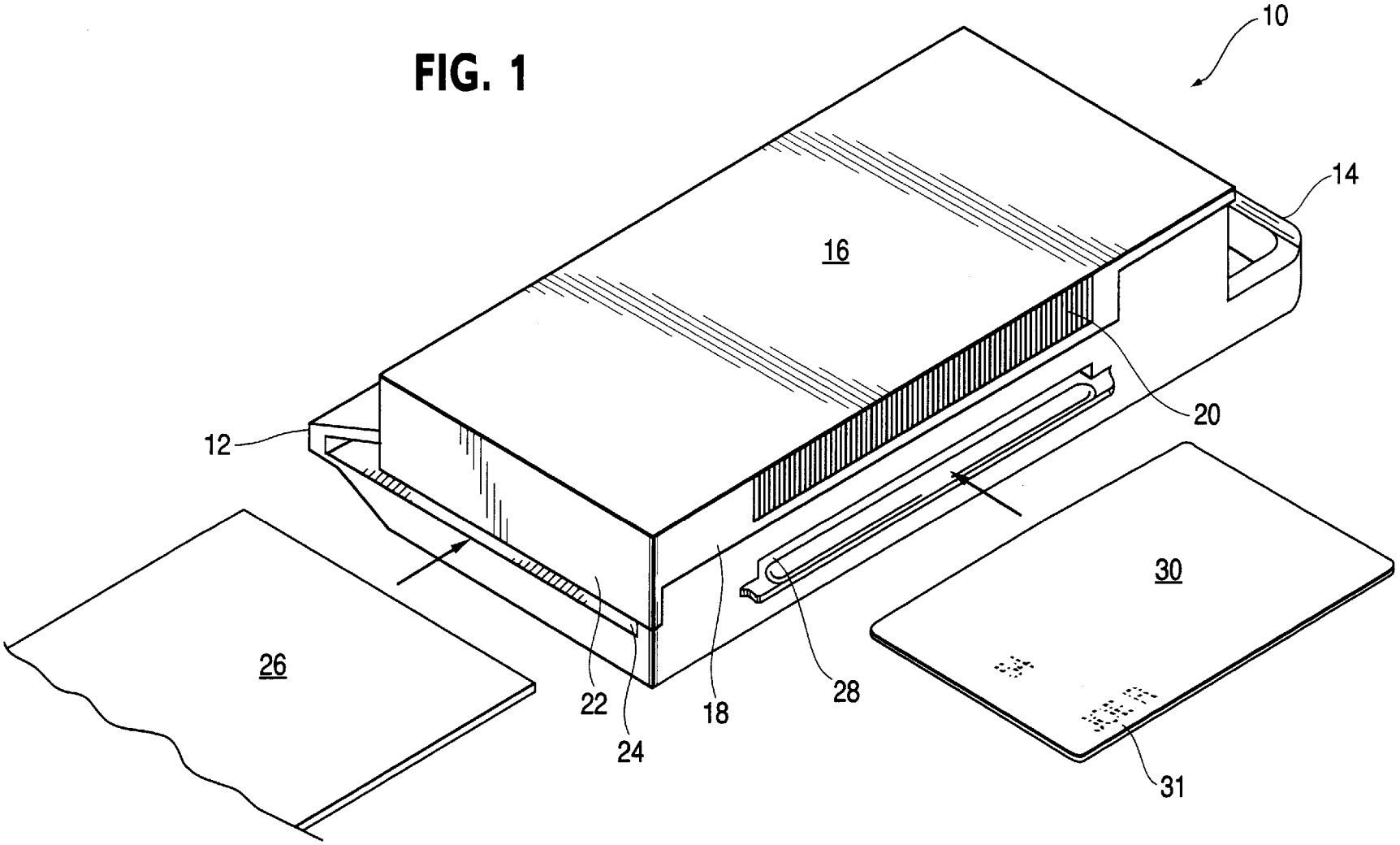
FIG. 1 is perspective view of a preferred embodiment of the imprinter of the present invention with the lid in the closed position.

FIG. 1 shows the imprinter, generally designated by the reference numeral 10, including a base 12, having a handle 14, and a lid 16. The lid has longitudinally extending side surfaces 18, each of which preferably has a roughened gripping surface 20. The lid 16 has a downwardly extending end 22 which only partially closes an opening 24 in the base into which a formset 26 can be inserted. The base 12 also has a slot or opening 28 into which a credit card 30 bearing characters 31 can be inserted. FIG. 1 shows the lid 16 in the closed position.

Figure 2:
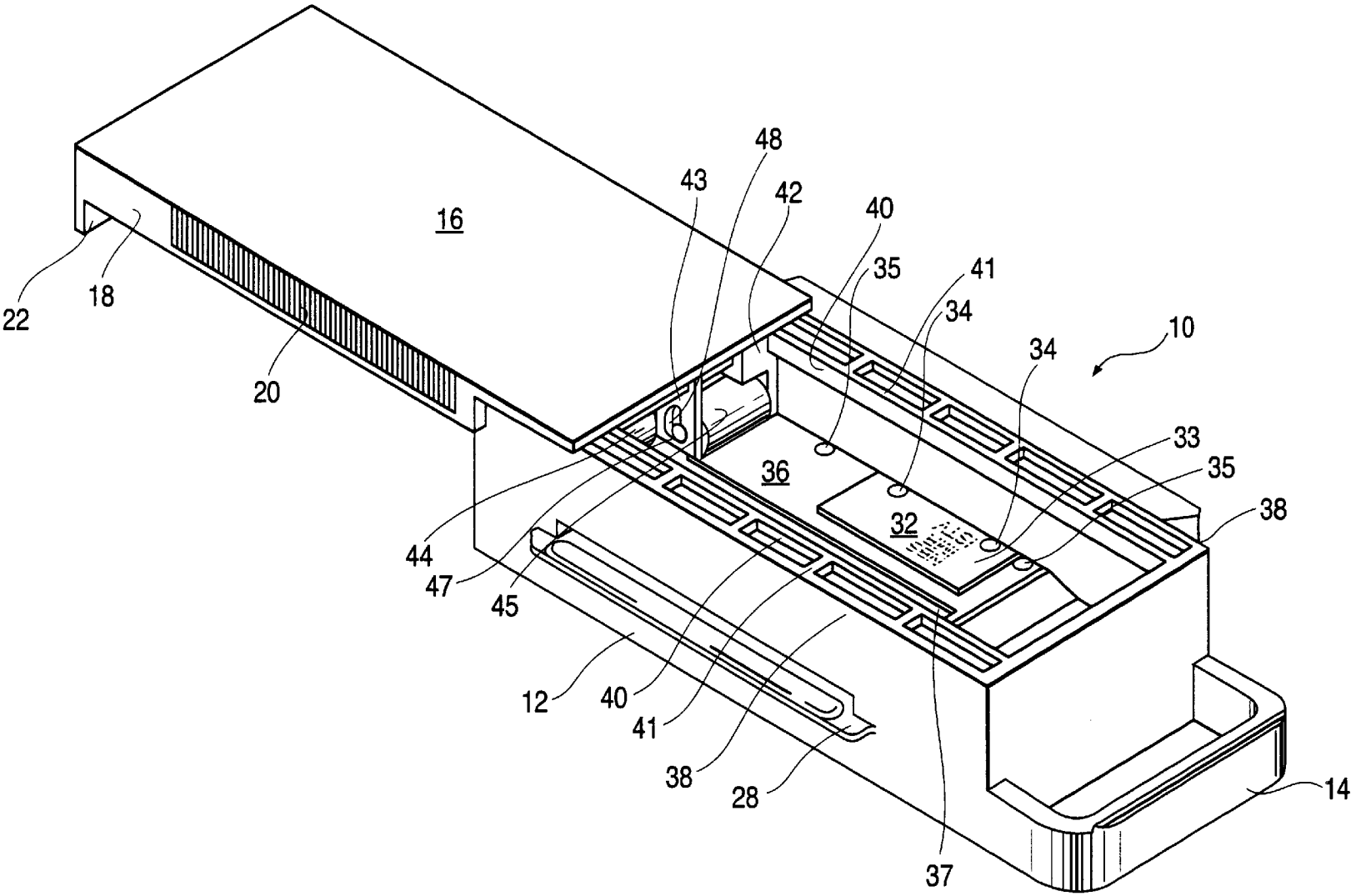
FIG. 2 is a perspective view of the imprinter of FIG. 1, with the lid in the open position.
Figure 3:
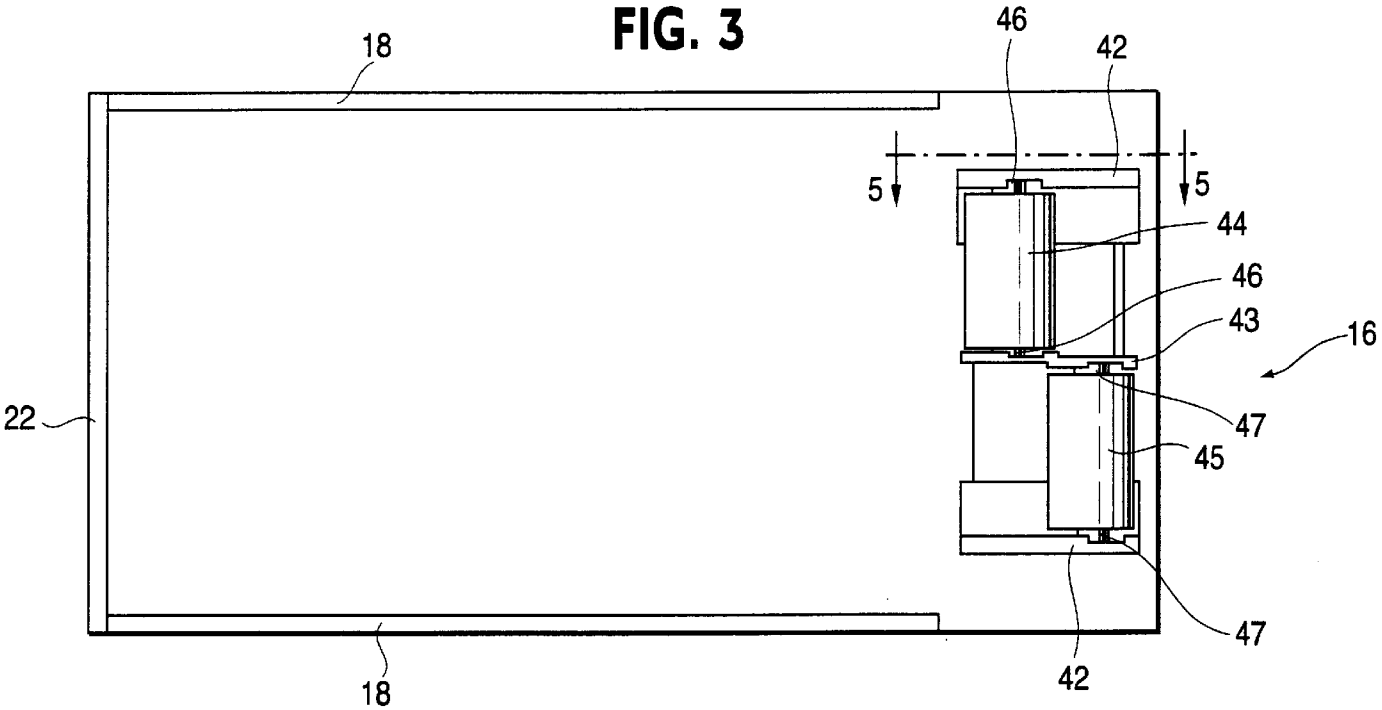
FIG. 3 is a bottom view of the lid of the imprinter of FIG. 1.

FIG. 2 shows the imprinter 10 with the lid 16 in the open position. With the lid 16 in the open position, the station plate 32 can be seen; the station plate 32 includes characters 33 which communicate information to be transferred to the formset 26 concerning the merchant. The station plate 32 is preferably removably attached to the base 12 by tabs 34 which can be tightened from the underside of the base 12. The base 12 can include additional tabs 35 which can be used to attach station plates of different sizes.

The base 12 has a flatbed 36 on which the station plate 32 can be attached and on which the credit card 30 and formset 26 are provided during use. Preferably, the flatbed 36 has an indentation 37 shaped to receive a portion of the credit card 30. The indentation 37 is shaped in conjunction with the size of the slot 28, as is known in the art, so that the credit card is inserted to the proper depth to capture the necessary characters 31 from the credit card, typically including the credit card number, expiration date and holders name.

The base 12 has opposed, upwardly and longitudinally extending sides 38 on which the lid 16 slides. More particularly, the top of the sides 38 of the base 12 are provided with longitudinally and inwardly extending lips 40 having a top surface 41 on which the underside of the lid 16 slides.

As can be partially seen in FIG. 2, and as more clearly seen in FIGS. 3–7, attached to or integral with the lid 16 are platen holder supports, including outer supports 42 and a central support 43 supporting rolling platens 44 and 45. The rolling platens 44, 45 are supported on the platen holder supports 42, 43 by axles 46, 47 which are provided in openings 48 in the platen holder supports 42, 43. In this embodiment, a single central support 43 is shown, although it would also be possible to include separate central supports for each of the platens 44, 45.

Figure 4:
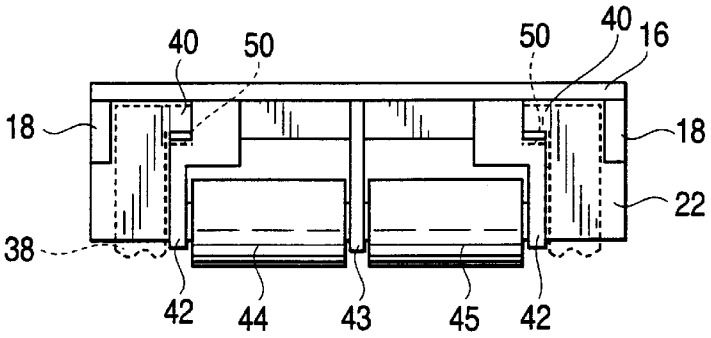
FIG. 4 is an end view of the lid shown in FIG. 3.

As is most clearly seen in FIG. 4, the outer supports 42 are formed with a ledge 50 so that a groove is formed between the ledge 50 and the underside of the lid 16, in which groove the lip 40 of sidewall 38 of base 12 is engaged. While, in the embodiment shown in the drawings, the ledge 50 is provided on the supports 42 to form the groove, it is possible to engage the lip 40 of the side walls 38 in some other manner, e.g., by engaging the lip 40 with an additional support other than the platen holder supports 42. In addition, it is possible for the lid to have a lip and the sidewalls to have a groove to engage the lip.

Figure 5:
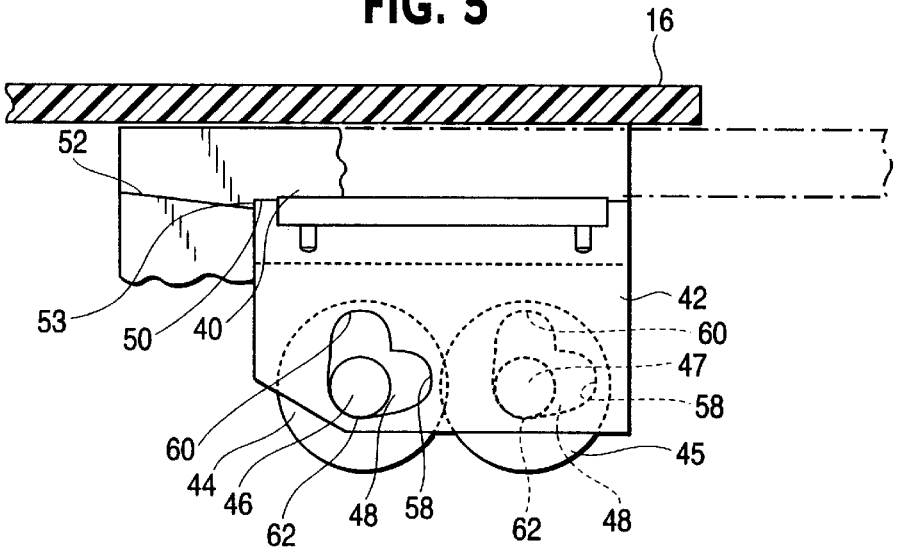
FIG. 5 is a partially cut-away cross-sectional view along line 5—5 of FIG. 3.

The ends of the lips 40 (in this embodiment at the same end of the base 12 as is provided the formset slot 24) are provided with wedge shaped tabs 52 which are inclined to enable the lid to be assembled on the base by sliding the groove between the ledge 50 and the underside of the lid 16 past the wedge 52. The wedge 52 has a ledge 53 which forms an end of travel stop for the lid 62 when the ledge 50 of the support 42 abuts the same, as shown in FIG. 5.

In a preferred form of the present invention, an insert member 54 is provided in each support 42 to reduce the friction between the lip 40 and the support 42 during sliding of the lid 16 between the open and close positions. The insert member 54 can be made of a plastic having a low coefficient of friction, e.g., from acetyl resin.

The openings 48 in the supports 42, 43 are provided with a special shape to achieve imprinting during movement of the lid in one direction (in the embodiment shown in the drawings from the closed to the open direction) and to avoid smudging of the formset during movement of the lid in the opposite direction (in the embodiment shown in the drawings from the open to the closed position). While the embodiment shown in the drawings is a single stroke imprinter, the invention can be modified to provide a double stroke imprinter by reversing the opening 48 of one of the platens to be a mirror image of the openings 48 for the other platen, as will be apparent from the explanation hereinafter.

Each opening 48 is provided with at least two lobe shaped portions 58, 60, each having a closed end and an open end, joined together at their open ends to form a substantially L-shaped opening 48. The closed end of the first lobe 58 of each opening 48 substantially faces a direction parallel to the longitudinal axis of the flatbed 36. In the embodiment shown in the drawings, the closed ends of the lobes 58 face the direction shown by the arrow 56 in FIG. 7, which is the direction of opening of the lid 16. The second lobes 60 of each L-shaped opening 48 substantially face the flatbed. By substantially facing, applicant intends not only directly facing but also an inclination which would not materially affect the operation of the imprinter, as will be apparent from the explanation provided hereinafter. It is preferable that the open ends of the lobes 58, 60 be extended at the portion at which they join or that there be provided, as in the embodiment shown in the drawings, a third lobe 62 having an open end at the portion at which the first and second lobes 58, 60 join.

During movement of the lid between the open and closed positions, the force exerted by the lips 40 on the ledge 50, including insert 54 of the supports 42, forces the supports, and hence the rolling platens 44, 45, downwardly towards the formset 26 provided on flatbed 36. As can be seen most clearly from FIG. 7, during movement of the lid from the closed to the open position, i.e., in the direction of the arrow 56, the force of gravity and the frictional forces between the platens 44, 45 and the flatbed 36 or formset 26 force the axles 46, 47 into the closed end of the first lobe 58 of each opening 48. The first lobe 58 is provided at a position on supports 42, 43, such that when the axles 46, 47 are forced into the closed end of the first lobes 58, the rolling platens 44, 45 apply rolling forces to the formset 26 over the credit card 30 and station plate 32 in such a fashion as to imprint the characters 31, 33 from the credit card 30 and station plate 32, respectively, onto the formset 26.

This arrangement requires no adjustment mechanism, such as set screws, since the distance between the axles 46, 47 of the rolling platens 44, 45 and the flatbed 36 during movement of the lid in the direction 56 is determined solely by the distance between the first lobes 58 and the flatbed 36.

Figure 6:
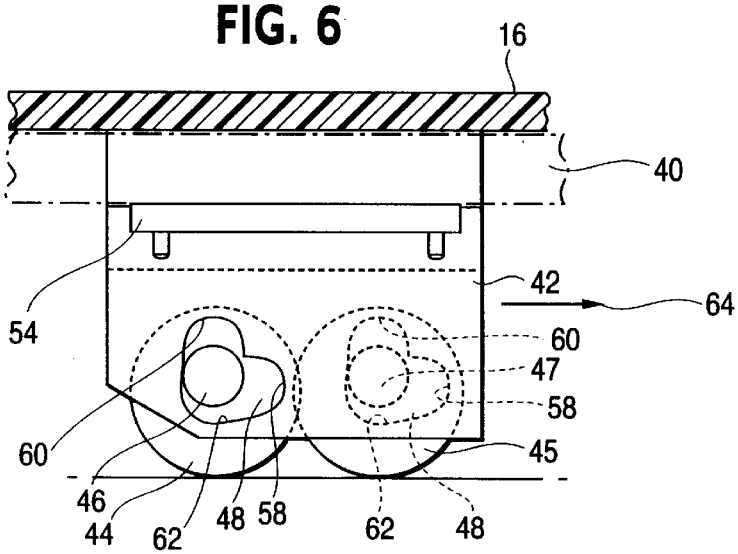
FIGS. 6 and 7 are cross-sectional views showing the effects of moving the lid in two opposed directions.
Figure 7:
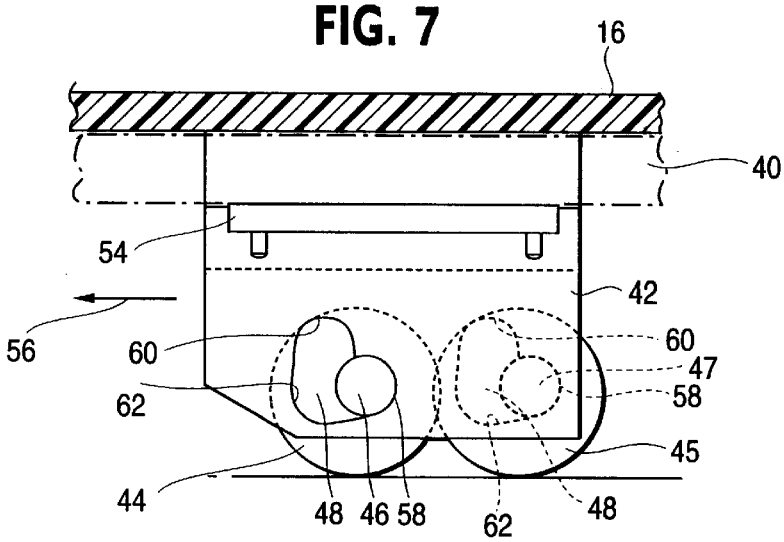

As can be most clearly seen from FIG. 6, as the lid 16 is moved in the second direction 64 (in the embodiment shown in the drawings from the closed position to the open position), the force of friction between the rolling platens 44, 45 and the flatbed 36 or formset 26 force the axles 46, 47 out of the closed end to the open end of the first lobes 58 and into the open end of the second lobes 60. As the rolling platens 44, 45 travel back over the formset in this return stroke (in the embodiment shown in the drawings when the lid is moved from the open position to the closed position), the axles 46 and 47 are free to move upwardly to the closed end of the second lobe 60 so as not to smudge the formset 26 on the return stroke.

As will be apparent to one skilled in the art based on the foregoing description, if it is desired to provide a double stroke imprinter, it is only necessary to reverse the L-shaped openings 48 holding the first of the two rolling platens so that the openings 48 holding the axle of the first of the rolling platens are provided as a mirror image of the openings 48 holding the axle of the second rolling platen. By doing so, forces applied during movement of the lid in the first direction 56 will cause the axle of the first rolling platen to move into the first lobes 58 so that a periphery of the first rolling platen is forced toward the flatbed 36 to imprint characters from one of the credit card 30 and station plate 32, and cause the axle of the second rolling platen to move into the second lobe 60 so that a periphery of the second rolling platen is allowed to move away from the flatbed 36. Conversely, forces applied during movement of the lid in the second direction 64 will cause the axle of the second rolling platen to move into the first lobes 58 so that a periphery of the second rolling platen will be forced toward the flatbed 36 to imprint characters from the other of the credit card 30 and station plate 32, and cause the axle of the first rolling platen to move into the second lobes 60 so that a periphery of the first rolling platen is allowed to move away from the flatbed 36, so as not to smudge the formset 26.

While the invention has been described in terms of its preferred embodiments, it should be understood that numerous modifications may be made thereto without departing from the spirit and scope and invention as defined in the appended claims. It is intended that all such modifications fall within the scope of the appended claims.

I claim:

1. An imprinter, comprising:

a base having a flatbed for receiving at least one character bearing element having characters to be imprinted on a print receiving element, and having a pair of opposed upwardly extending sides;

a lid having a top surface, a pair of platen holder supports, and downwardly extending sides engaged with and slidable along the upwardly extending sides of the base, to support the lid for sliding motion in first and second opposed directions along the flatbed and to limit movement of the lid orthogonal to the flatbed during movement in the first and second directions, each of the platen holder supports having a pair of opposed sidewalls having opposed axle supporting openings therein, wherein the axle supporting openings have at least two lobe shaped portions, each having a closed end and an open end, joined together at their open ends to form a substantially L-shaped opening, wherein closed ends of the respective, opposed first lobes substantially face the first direction and the closed ends of the respective, opposed second lobes substantially face the flatbed; and first and second rolling platens attached to the platen holder supports of the lid, each of the first and second rolling platens having an axle supported in the opposed axle supporting openings of the sidewalls;

whereby, forces applied during movement of the lid in the first direction cause the axles of the rolling platens to move into the first lobes so that peripheries of the rolling platens are forced towards the flatbed to imprint characters from the at least one character bearing element on the print receiving element, and forces applied during movement of the lid in the second direction cause the axles of the rolling platens to move into the second lobes so that a periphery of the rolling platen is allowed to move away from the flatbed.

2. An imprinter, comprising:

a base having a flatbed for receiving at least one character bearing element having characters to be imprinted on a print receiving element, and having a pair of opposed upwardly extending sides;

a lid having a top surface, a pair of platen holder supports, and downwardly extending sides engaged with and slidable along the upwardly extending sides of the base to support the lid for sliding motion in first and second opposed directions along the flatbed and to limit movement of the lid orthogonal to the flatbed during movement in the first and second directions, each of the platen holder supports having a pair of opposed sidewalls having opposed axle supporting openings therein, wherein the axle supporting openings have at least two lobe shaped portions, each having a closed end and an open end, joined together at their open ends to form a substantially L-shaped opening, wherein the first rolling platen unit has opposed axle supporting openings having closed ends of the respective, opposed first lobes substantially facing the first direction and the closed ends of the respective, opposed second lobes substantially facing the flatbed, and wherein the second rolling platen unit has opposed axle supporting openings having closed ends of the respective, opposed first lobes facing the second direction and the closed ends of the respective, opposed second lobes facing the flatbed; and first and second rolling platens attached to the platen holder supports of the lid, each of the first and second rolling platens having an axle supported in the opposed axle supporting openings of the sidewalls;

whereby, forces applied during movement of the lid in the first direction cause the axle of the first rolling platen of the first rolling platen unit to move into the first lobes so that a periphery of the first rolling platen is forced towards the flatbed to imprint characters from the at least one character bearing element on the print receiving element, and cause the axle of the second rolling platen of the second rolling platen unit to move into the second lobes so that a periphery of the second rolling platen is allowed to move away from the flatbed, and forces applied during movement of the lid in the second direction cause the axle of the second rolling platen of the second rolling platen unit to move into the first lobes so that a periphery of the second rolling platen is forced towards the flatbed to imprint characters from the at least one character bearing element on the print receiving element, and cause the axle of the first rolling platen of the first rolling platen unit to move into the second lobes so that a periphery of the first rolling platen is allowed to move away from the flatbed, wherein a distance between the axle of the first rolling platen and the flatbed during movement of the lid in the first direction and a distance between the axle of the second rolling platen and the flatbed during movement of the lid in the second direction are determined solely by the distance between the respective first lobes and the flatbed.

* * * * *